US008061513B2

(12) United States Patent
Shanahan, Sr. et al.

(10) Patent No.: US 8,061,513 B2
(45) Date of Patent: Nov. 22, 2011

(54) USB FLASH DRIVE WITH INTEGRATED MEDICATION HOLDER

(75) Inventors: John Shanahan, Sr., Newport Beach, CA (US); Joshua Ho, Los Angeles, CA (US)

(73) Assignee: Very Special Hearts, LLC, Irvine, CA (US)

( * ) Notice: Subject to any disclaimer, the term of this patent is extended or adjusted under 35 U.S.C. 154(b) by 264 days.

(21) Appl. No.: 12/195,902

(22) Filed: Aug. 21, 2008

(65) Prior Publication Data

US 2010/0044272 A1 Feb. 25, 2010

(51) Int. Cl.
*A45C 15/00* (2006.01)
*B65D 83/04* (2006.01)

(52) U.S. Cl. ..... 206/38; 206/307; 206/538

(58) Field of Classification Search ..... 206/38, 206/37, 528, 535, 536, 538, 307, 223
See application file for complete search history.

(56) References Cited

U.S. PATENT DOCUMENTS 6,851,552 B1 * 2/2005 Chao ..... 206/5
7,233,232 B2 * 6/2007 Chen ..... 340/426.13
7,389,878 B1 * 6/2008 Torrico ..... 206/725
7,448,905 B1 * 11/2008 Lin ..... 439/577
7,461,742 B2 * 12/2008 Or et al. ..... 206/463
7,520,389 B2 * 4/2009 Lalouette ..... 206/722
2006/0015368 A1 * 1/2006 Hockey ..... 705/2
2007/0235350 A1 * 10/2007 Warlick ..... 206/37
2008/0006556 A1 * 1/2008 Bhuchar ..... 206/457
2008/0299825 A1 12/2008 Lin

FOREIGN PATENT DOCUMENTS

DE 202005011196 U1 11/2005
DE 202007016943 U1 3/2008
WO WO-2007/082543 A1 7/2007

OTHER PUBLICATIONS

English abstract provided for DE-202005011196.
ISR for PCT/US2009/051918.

* cited by examiner

*Primary Examiner* — Jacob K Ackun
(74) *Attorney, Agent, or Firm* — Rader, Fishman & Grauer PLLC

(57) ABSTRACT

A device, including a substantially hollow container, a flash memory data storage medium selectively enclosed by the container and a substantially enclosed cavity disposed within the container configured to selectively receive and dispense a portion of a medication. A method for using the device is also disclosed.

17 Claims, 6 Drawing Sheets

USB FLASH DRIVE WITH INTEGRATED MEDICATION HOLDER

TECHNICAL FIELD

A data storage device is integrated with a medication holder, and more particularly a wearable adornment includes a flash memory storage device and a cavity for holding a portion of medication.

BACKGROUND

Medical bracelets, and the like, may be used to alert others to the existence of a medical condition of the wearer. However, medical bracelets cannot provide detailed information about the medical condition, much less information of particular relevance to the wearer. Moreover, medical bracelets do not have the ability to provide anything more than a mere notification. If the wearer becomes incapacitated, medical assistance personnel will have to undertake an investigation to determine the nature of the medical condition.

Some medical bracelets may include a serial or code number that is uniquely associated with the wearer. The serial number may be used as a key or reference number for identifying medical information about the wearer, which may be stored in an external storage location. While such an approach can address the limited amount of information available to medical assistance personnel, it also introduces new problems related to accessing the external records. For example, the medical assistance personnel will need to be able to identify the entity that maintains the medical records. Also, there is a risk that the external records maintainer is no longer available to provide the records. Moreover, the time it takes to access the external records may reduce the available time to treat the wearer.

Increasingly, medications can include lengthy and detailed instructions. The instructions may address the procedure for taking the medication as well as information about interactions with other medications. These instructions and interaction warnings can be difficult to remember. Additionally, this information, as well as complete medical records, may need to be provided to medical assistance personnel that do not have prior knowledge of the medical history of a patient. The amount of storage capacity needed for medical histories and records is also increasing rapidly, particularly when copies of medical imaging reports are included. Transferring this amount of information from a remote storage site to the location of the patient may not be practical, especially in emergency situations.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

DETAILED DESCRIPTION

Figure 1:
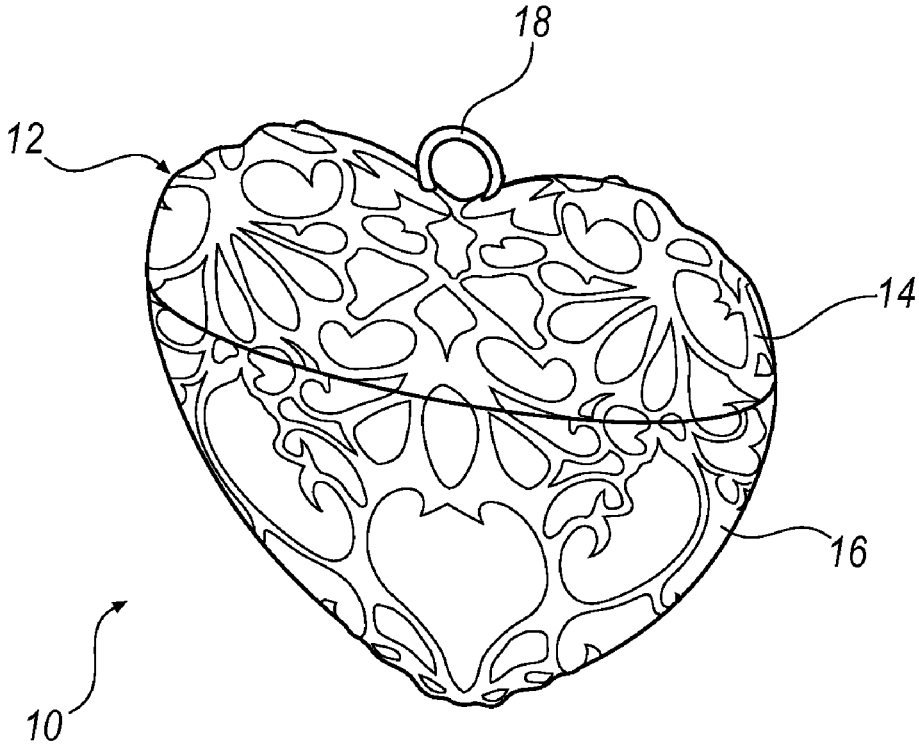
FIG. 1 is a perspective view of the ornamental body of a device containing a USB flash drive with an integrated medication holder.
Figure 2:
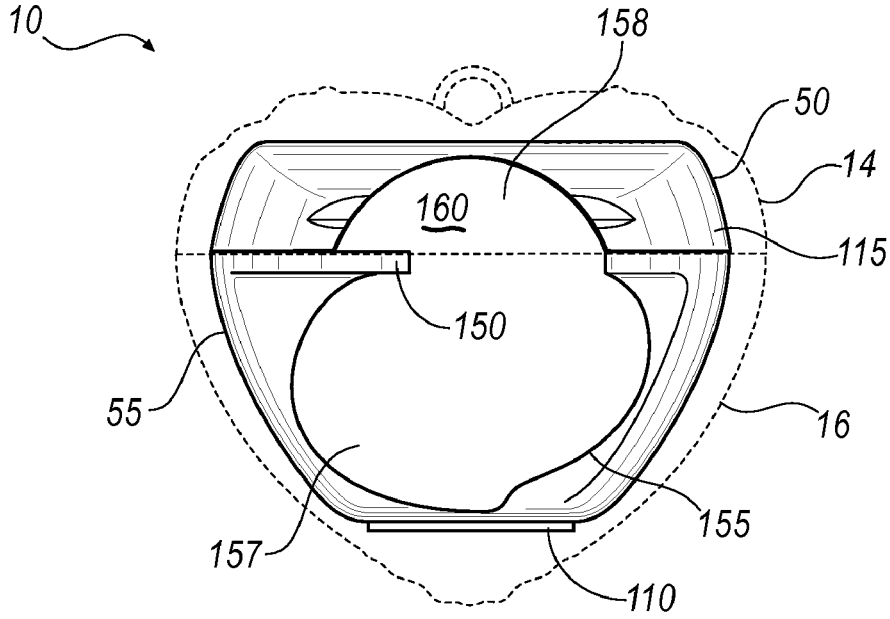
FIG. 2 is an front end view of an insert configured to be inserted into the body of the device.
Figure 3:
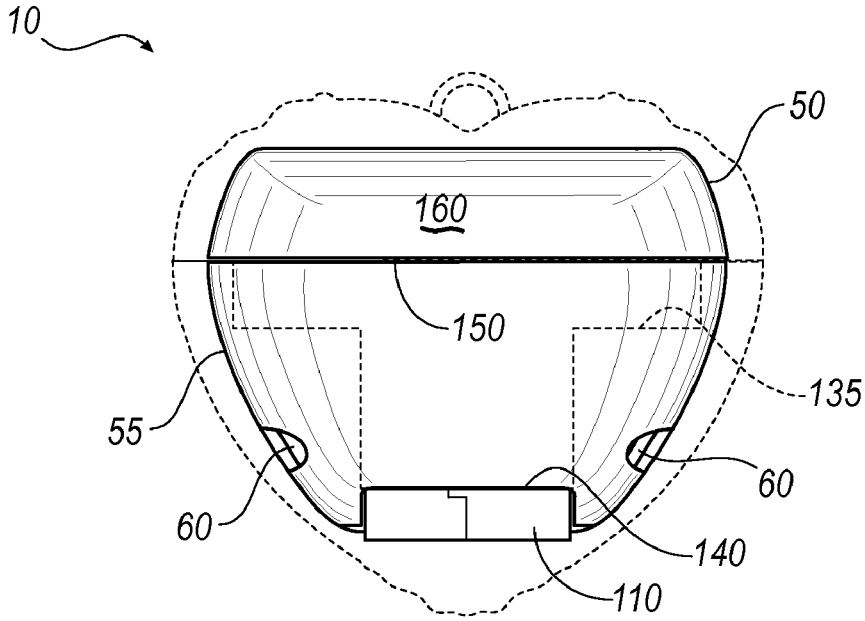
FIG. 3 is a rear end view of the insert from FIG. 2.
Figure 4:
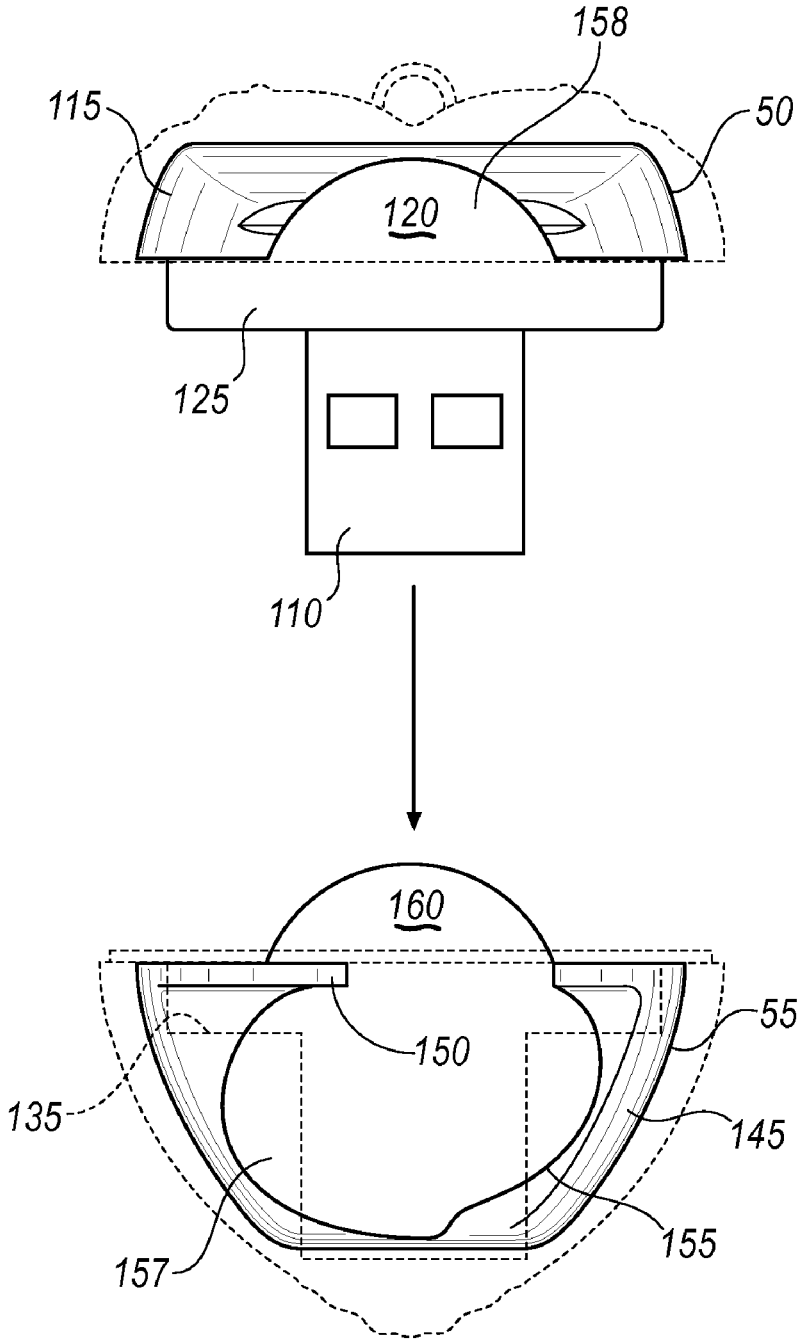
FIG. 4 is an exploded view of the insert from FIG. 2.
Figure 5:
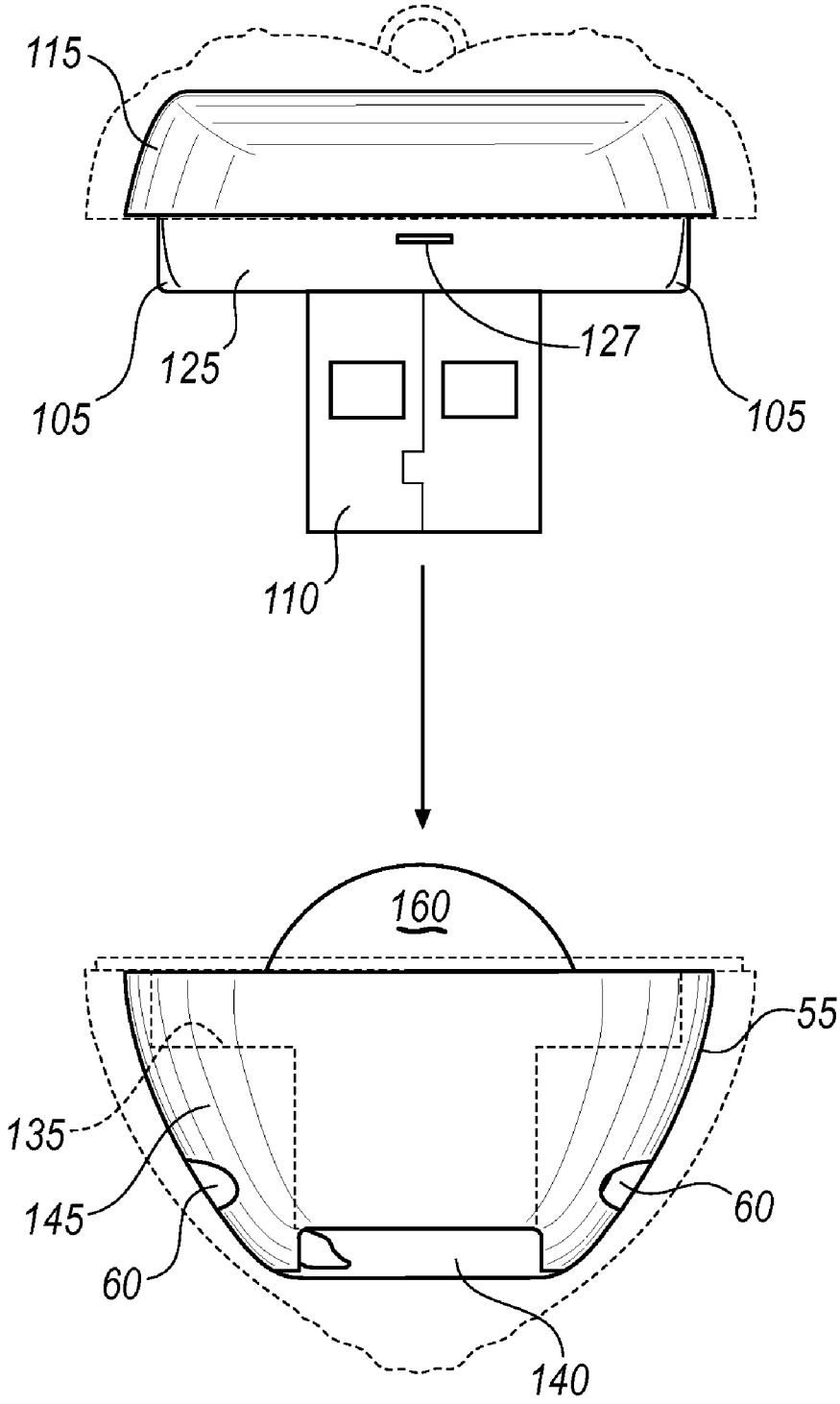
FIG. 5 is an exploded view of the insert from FIG. 3.

Exemplary illustrations of a Universal Serial Bus (USB) flash drive with an integrated medication holder are described below. In the interest of clarity, not all features of an actual implementation are described in this specification. It will of course be appreciated that in the development of any such actual illustration, numerous implementation-specific decisions must be made to achieve the developers' specific goals, such as compliance with system-related and business-related constraints that will vary from one implementation to another. Moreover, it will be appreciated that such a development effort might be complex and time-consuming, but would nevertheless be a routine undertaking for those of ordinary skill in the art having the benefit of this disclosure.

Referring now to the drawings wherein like numerals indicate like or corresponding parts throughout the several views, certain examples of the disclosure are illustrated.

FIG. 1 is a perspective view of a Universal Serial Bus (USB) flash drive with an integrated medication holder 10. The USB flash drive typically includes a solid state, flash memory based data storage medium and a controller. The controller may regulate the storage and retrieval of data to and from the storage medium and may implement the USB mass storage device protocol, as well as additional customized software modules. The controller and flash memory storage medium may be included on and interconnected by a printed circuit board (PCB). The solid state storage medium may include flash memory such as NAND based electrically erasable programmable read-only memory (EEPROM).

The USB flash drive may be used as a general data storage unit for any type of data. However, the USB flash drive may be ideally suited for storing medical history data and medical records. Solid state flash memory, when coupled with a USB controller provides a data storage medium known as a USB flash drive. USB flash drives are a well supported and relatively inexpensive medium for storing vast amounts of data. Accordingly, an individual may be able to store their entire medical history, including medical imaging records. Moreover, a USB flash drive may be provided in small form factor, such as the depicted device 10, for easily carrying data on one's person. Therefore, medical data may be available to the individual or attending medical assistance personnel nearly instantaneously.

The device 10 may be provided with a main body 12, such as a piece of jewelry. An ornamental design may be disposed of at least a portion of the main body 12. A wearable pendant or locket may provide one possible main body 12 and may provide a surface for an ornamental design. The main body 12 may be a substantially hollow container suitable for selectively enclosing the USB flash drive. Accordingly, the main body 12 may be divided between a first element 14 and a second element 16 to allow for accessing the USB flash drive contained therein.

The first 14 and second 16 elements of the main body 12 typically may be configured to be operably connected to each other. For example, the first element 14 may provide a cap or enclosure to the second element 16. Moreover, the first element 14 and the second element 16 may be selectively joined with a snap fit. However, in another exemplary approach, the first element 14 may be attached to the second element 16 via a hinge. A loop 18 or other attachment element may be disposed on the body 12 to facilitate the wearability of the device 10 through the use of a necklace, bracelet, or the like. Similarly, the loop 18 may allow the device 10 to be attached to other commonly carried items such as a key chain.

As depicted in FIGS. 2-5, the main body 12 may support an insert 50 disposed therein. The insert 50 may be divided into a casing 115 and a receiver portion 55. When including the device 10 in an ornamental body 12 such as a piece of metallic jewelry, the use of an insert 50 may provide a number of advantages. For example, the insert 50 may be composed of a polymeric material such as an injection molded plastic. The insert 50 therefore, may be shaped, molded, formed, milled, etc. into any number of forms to correspond to the design of the main body 12. In the depicted example, the insert 50 roughly approximates the heart shape design of the main body 12. The insert 50 may securely position and hold the USB flash drive and a portion of medication within the body 12.

Further, the insert 50 may provide a casing 115 for the USB flash drive. As explained above, the USB drive is an electrical component that may be provided on a printed circuit board (PCB). Because the main body 12 may be metallic, the casing 115 may serve as an insulator to reduce the likelihood of a short from contact between the PCB and the body 12. A USB connector 110 may be attached to the PCB and may extend through the casing 115. However, in another exemplary approach, the casing 115 and the USB connector 110 may be an integrally molded element. Additional details of the USB connector 110 will be discussed below with respect of FIG. 6.

The insert 50 may provide a substantially enclosed cavity 155 for holding a portion of medication, e.g., a quantity of pills, tablets, capsules, etc. The cavity 155 may be a void formed on an outer surface 145 of the insert 50. Accordingly, medication may be held in the cavity 155 between the outer surface 145 of the insert 50 and the main body 12 of the device 10. The cavity 155 may include a main or lower cavity 157 and an upper cavity 158. As depicted, medication will normally be held in the lower cavity 157 simply as a result of gravity. However, if a sufficient quantity of medication is placed into the cavity 155, the medication may extend into the upper cavity 158. A lip 150 attached to the receiver portion 55 of the insert 50 may at least partially extend over the opening of the lower cavity 157. Accordingly, the lip 150 may be configured to regulate the portion of medication dispensed from the lower cavity 157. Moreover, the rounded sides of the lower cavity 157 in cooperation with the lip 150 may direct medication out of the lower cavity.

The receiver portion 55 of the insert 50 may further include a medication assist guide 160. The medication assist guide 160 may be a protruding surface that extends out from the lip 150 and the opening of the lower cavity 157. The medication assist guide 160 may serve at least two purposes including aligning the receiver portion 55 and the casing portion 115 of the insert 50 as well as providing a guide surface to assist with filling the lower cavity 157 with a portion of medication. A guide channel 120 provided on the surface of the casing 115 may receive the medication assist guide 160 when the receiver portion 55 is joined with the casing 115. Accordingly, the guide channel 120 and the medication assist guide 160 may align the casing 115 with the receiver portion 155. Moreover, the guide 160 and guide channel 120 can force a one-way fit between the first 14 and second 16 elements of the main body 12.

Because the opening of the lower cavity 157 may be narrow, the extension provided by the medication assist guide 160 may allow for a greater area for placing a portion of medication prior to insertion into the lower cavity. In an operational example, the second element 16 of the device 10, including the receiver portion 55 affixed therein, may be positioned horizontally such that the medication assist guide 160 provides a relatively flat, horizontal surface. A potion of medication may be placed on the guide 160 prior to reorienting the second element 16 to its normal vertical orientation. During the reorientation, the medication may slide down the guide 160 into the lower cavity 157. Similarly, in an opposite operation, the lip 150 in cooperation with the guide 160 may direct the medication dispensed out of the lower cavity 157.

The casing 115 of the insert may include an extender portion 125. The extender portion 125 may position the USB connector 110 away from the main body 12, which otherwise could potentially interfere with connecting the connector 110 to a USB socket on a host computer. The extender portion 125 may provide additional protection of the printed circuit board of the USB flash memory drive, which might otherwise not be covered by the casing 115. A protrusion 127 on the extender portion 125 may facilitate the snap fitting of the first 14 and second 16 elements of the main body 12. Additionally, to assist in aligning the first 14 and second 16 elements, notches 105 may be provided on the extender portion 125.

The receiver portion 55 of the insert 50 may include a base surface 135 as well as a connector opening 140. The base surface 135 may be configured to abut the extender portion 125 when the first 14 and second 16 elements are joined. Alignment surfaces 130 corresponding the notches 105 may be provided on the base surface 135 to ensure a one-way fit between the first 14 and second 16 elements. The connector opening 140 provides a channel or void through the receiver portion 55 for accepting the USB connector 110 when the first 14 and second 16 elements are joined. The connector opening 140 may be shaped to correspond the shape of the USB connector 110. Moreover, the connector opening 140 may be shaped as a rectilinear channel that is open on both ends. The receiver portion 55 may also include attachment points 60 for interconnecting with the second element 16 of the main body 12.

Figure 6:
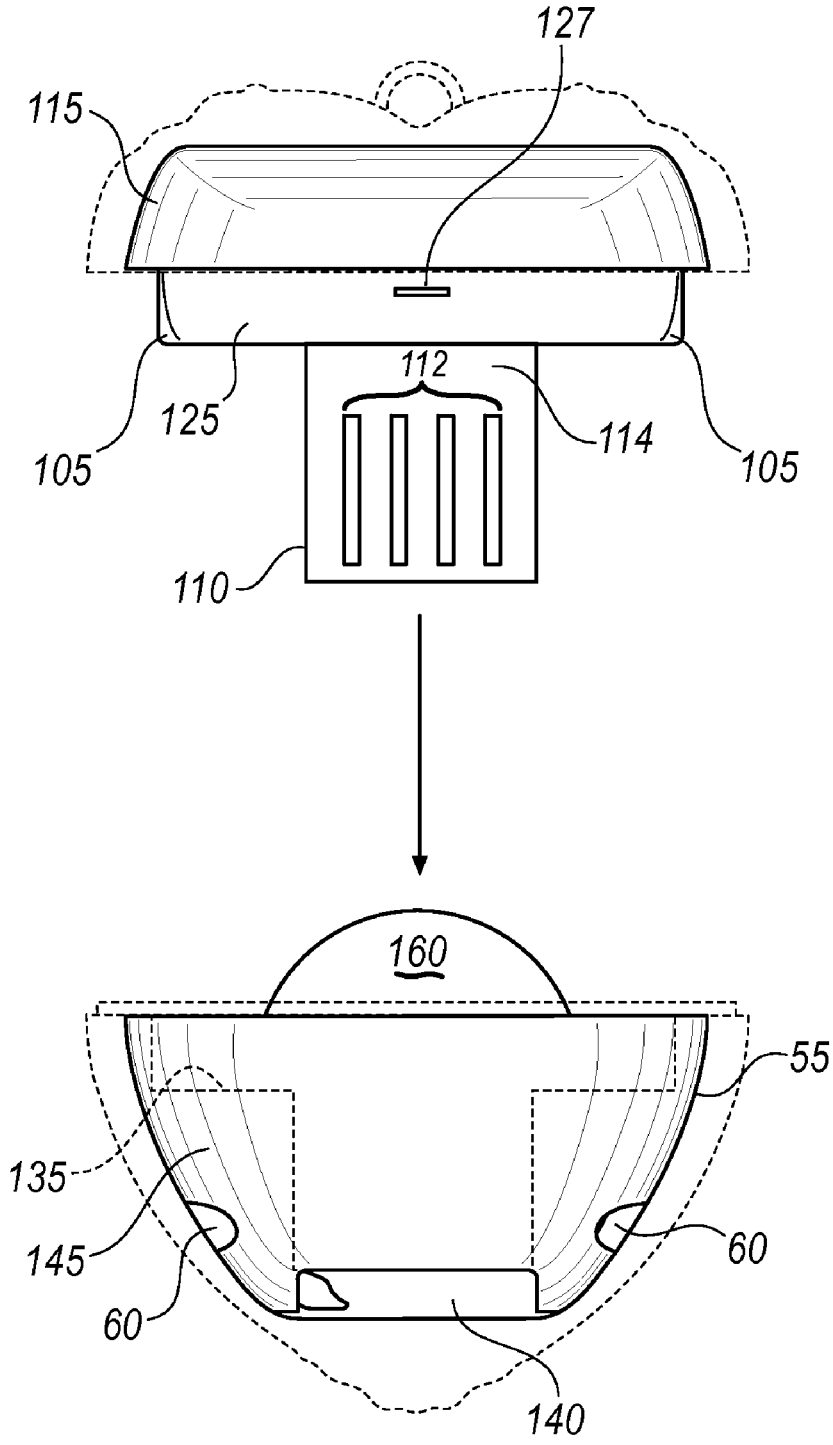
FIG. 6 is an exploded view of the device with another exemplary USB connector.

FIG. 6 illustrates the above-described device 10 with another exemplary USB connector 110. In this example, the contact points 112 for the USB connection are disposed directly on the printed circuit board 114 of the USB flash drive. Moreover, a portion of the printed circuit board 114 extends out through the casing 125. A USB connector 110 with the depicted thin form factor may suitable for host devices that cannot accommodate the size of a standard USB connector. Similarly other USB connector form factors may be appropriate for a particular host device. Additionally, the flash memory drive may communicate via a data transmission protocol other than USB.

Figure 7A:
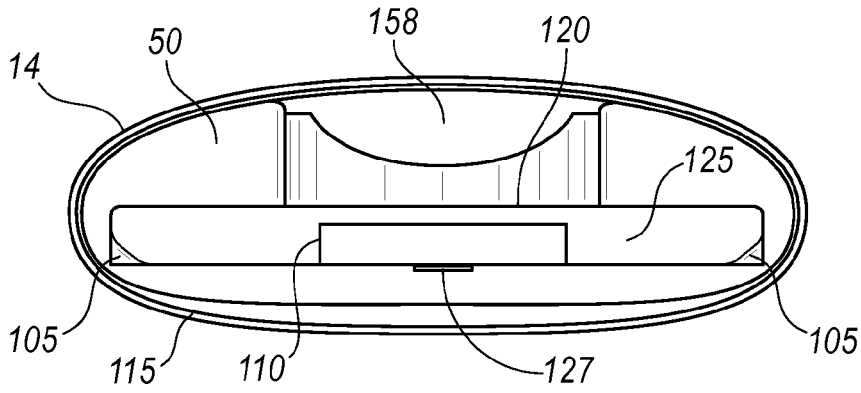
FIG. 7A is a top end view of a first element of the device.
Figure 7B:
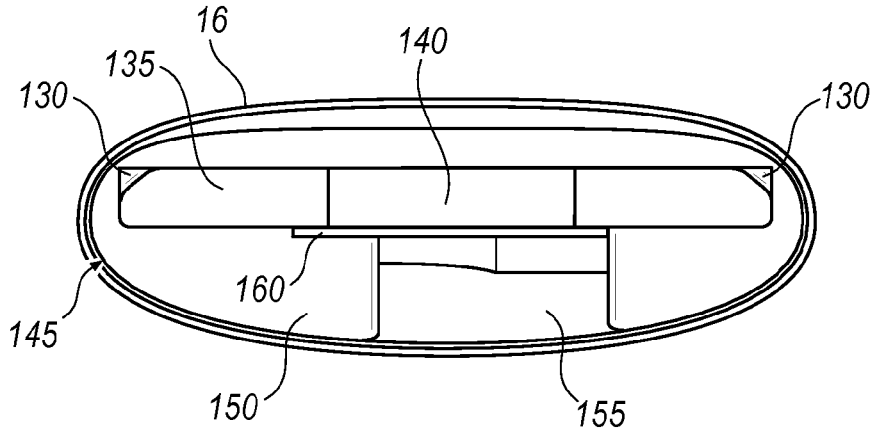
FIG. 7B is a top end view of a second element of the device.

FIGS. 7A and 7B respectively illustrate end views of the first 14 and second 16 elements of the main body 12. The end views illustrate the openings of the lower 157 and upper 158 cavities. The lip 150 extends over at least a portion of the opening of the lower cavity 157. The alignment of the first 14 and second 16 elements in their joined configuration may be maintained by the notches 105 and alignment surfaces 130 of the respective extender portion 125 and base surface 135.

While depicted as an ornamental locket or adornment in FIG. 1, the main body 12 may provide a more utilitarian design. For example, the main body 12 may be combined with the casing 115 to reduce the number of elements of the device 10. Moreover, the insert 50 may be omitted or provided as a unitary element along with the main body 12. In this approach, the main body 12 may simply provide an enclosure to house the USB flash memory drive and the cavity 155. However, in such an approach, the cavity 155 may need a lid or cover to provide a substantially enclosed cavity that would otherwise be provided by the main body 12. For example, the receiver potion 55 may include a removable, or otherwise openable, covering to secure any medication held therein.

The following operational example discloses a method for using the device 10. The device 10 may originate in a closed or joined configuration without any data stored on the USB flash drive and without any medication stored in the cavity 155. The first 14 and second 16 elements of the main body 12 may be separated by forcefully overcoming the snap fit provided by the protrusion 127. Medical history data, medication information, etc., may be received by the USB flash drive when the connector 110 is attached to a host computer system. A portion of medication may be accepted into the cavity 155. For example, the second element 16 of the device 10, including the receiver portion 55 affixed therein, may be positioned horizontally such that the medication assist guide 160 provides a relatively flat, horizontal surface. A potion of medication may be placed on the guide 160 prior to reorienting the second element 16 to its normal vertical orientation. During the reorientation, the medication may slide down the guide 160 into the lower cavity 157. The first 14 and second 16 elements may then be rejoined to securely hold the medication in the cavity 155.

To accesses either the portion of medication or the data stored on the USB flash drive, the device 10 may be opened by separating the first 14 and second 16 elements of the body 12. The device can provide access to the data once the connector 110 is inserted into a host computer system. In an emergency situation, medical assistance personnel may use the device 10 to access data regarding the person requiring medical attention. Some or all of the portion of medication stored in the cavity 155 may be dispensed by at least partially inverting the second element 16. The lip 150 in cooperation with the guide 160 may direct and regulate the medication dispensed out of the lower cavity 157.

Computing devices interfacing with the device 10 may employ any of a number of computer operating systems known to those skilled in the art, including, but by no means limited to, known versions and/or varieties of the Microsoft Windows® operating system, the Unix operating system (e.g., the Solaris® operating system distributed by Sun Microsystems of Menlo Park, Calif.), the AIX UNIX operating system distributed by International Business Machines of Armonk, N.Y., and the Linux operating system. Computing devices may include any one of a number of computing devices known to those skilled in the art, including, without limitation, a computer workstation, a desktop, notebook, laptop, or handheld computer, or some other computing device known to those skilled in the art.

Computing devices may each include instructions executable by one or more computing devices such as those listed above. Computer-executable instructions may be compiled or interpreted from computer programs created using a variety of programming languages and/or technologies known to those skilled in the art, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of known computer-readable media.

A computer-readable medium includes any medium that participates in providing data (e.g., instructions), which may be read by a computer. Such a medium may take many forms, including, but not limited to, non-volatile media, and volatile media. Non-volatile media include, for example, optical or magnetic disks and other persistent memory. Volatile media include dynamic random access memory (DRAM), which typically constitutes a main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Accordingly, exemplary devices 10 with USB flash drives with integrated medication holders have been described. The devices 10 may include a main body 12 with selectively joinable first 14 and second 16 elements. An insert 50, which may be selectively enclosed by the main body 12, may support a USB flash drive and provide a cavity 155 for storing a portion of a medication. The insert 50 may be divided into a casing that encloses the USB flash drive and a receiver portion that includes a lower portion 157 of the cavity 155 and secures the connector 110 of the USB flash drive. A lip 150 attached to the insert 50 may at least partially extend over the opening of the lower cavity 157. Accordingly, the lip 150 may be configured to regulate the portion of medication dispensed from the cavity 157. A guide 160 adjacent to the opening of the cavity 157 may be configured to assist with the insertion of the portion of medication into the cavity.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A device, comprising:

a substantially hollow container;

an insert disposed within the container including a casing and a receiver portion;

a flash memory data storage medium at least partially enclosed by the container and supported by the casing;

a substantially enclosed cavity provided by the receiver portion and configured to selectively receive and dispense a portion of medication, the cavity defining an opening; and a lip at least partially extending over the opening, the lip being configured to regulate the portion of medication dispensed from the cavity.

2. The device according to claim 1, wherein-the cavity is formed between a wall of the container and the insert.

3. The device according to claim 1, further comprising a guide adjacent to the opening, wherein the guide is configured to assist with the insertion of the portion of medication into the cavity.

4. The device according to claim 1, further comprising a first element of the container supporting the data storage medium and a second element of the container providing the cavity, wherein the first and second elements are configured to be selectively attached to each other.

5. The device of claim 3, wherein the casing defines a guide channel configured to receive the guide when the receiver portion is joined with the casing.

6. The device of claim 5, further comprising an extender portion disposed on the casing, the extender portion configured to further align the casing and receiver portion.

7. The device of claim 1, wherein the cavity forms at least a generally spherical shape.

8. A device, comprising:

a containing body;

an insert configured to be disposed within the containing body including a casing and a receiver portion;

a flash memory data storage medium supported by the casing;

a substantially enclosed cavity provided by the receiver portion and configured to selectively receive and dispense a portion of medication, the cavity defining an opening; and a lip at least partially extending over the opening, the lip being configured to regulate the portion of medication dispensed from the cavity.

9. The device according to claim 8, wherein the cavity is formed between a wall of the containing body and the insert.

10. The device according to claim 8, further comprising a guide adjacent to the opening, wherein the guide is configured to assist with the insertion of the portion of medication into the cavity.

11. The device according to claim 8, further comprising a first element of the containing body supporting the data storage medium and a second element of the containing body providing the cavity, wherein the first and second elements are configured to be selective attached to each other.

12. The device of claim 10, wherein the casing defines a guide channel configured to receive the guide when the receiver portion is joined with the casing.

13. The device of claim 8, wherein the cavity forms at least a generally spherical shape.

14. A device, comprising:

an openable container including a first element and a second element configured to selectively attach to the first element;

an insert disposed within the container including a casing and a receiver portion;

a flash memory data storage medium supported by the casing;

a substantially enclosed cavity provided by the receiver portion and configured to selectively receive and dispense a portion of medication, the cavity defining an opening; and a lip at least partially extending over the opening, the lip being configured to regulate the portion of medication dispensed from the cavity.

15. The device according to claim 14, further comprising a guide adjacent to the opening, wherein the guide is configured to assist with the insertion of the portion of medication into the cavity.

16. The device according to claim 14, wherein the casing is attached to the first element and the receiver portion is attached to the second element.

17. The device according to claim 14, wherein the cavity is formed between a wall of the second element and the receiver portion of the insert.

* * * * *